United States Patent [19]

Bertelsen

[11] Patent Number: 4,479,308

[45] Date of Patent: Oct. 30, 1984

[54] PROCESS AND DEVICE FOR RECOVERING HEAT FROM A PARTICULATE SOLID

[75] Inventor: Corey A. Bertelsen, Oakland, Calif.

[73] Assignee: Chevron Research Company, San Francisco, Calif.

[21] Appl. No.: 363,725

[22] Filed: Mar. 30, 1982

[51] Int. Cl.[3] ..... F26B 3/10; F26B 17/10

[52] U.S. Cl. ..... 34/10; 34/25; 34/20; 34/57 A; 34/171; 34/211

[58] Field of Search ..... 209/8 R, 11 R; 34/10, 34/57 A, 57 R, 211, 25, 31, 20, 168, 171, 177, 211; 432/15, 58; 165/104.16, 1

[56] References Cited

U.S. PATENT DOCUMENTS

| | | | |
|---|---|---|---|
| 3,423,840 | 1/1969 | Beeken | 34/57 A |
| 4,147,523 | 4/1979 | Izumo | 165/104.16 |
| 4,199,432 | 4/1980 | Tamm et al. | 208/8 R |
| 4,307,773 | 12/1981 | Smith | 34/57 A |
| 4,337,120 | 6/1982 | Spars et al. | 196/125 |
| 4,367,598 | 1/1983 | Hillinger et al. | 34/57 A |
| 4,383,912 | 5/1983 | Saadi et al. | 208/11 R |

*Primary Examiner*—Larry I. Schwartz

*Attorney, Agent, or Firm*—S. R. Lapaglia; W. K. Turner; D. P. Freyberg

[57] ABSTRACT

Heat is recovered from a hot particulate solid by passing the solid through a heat recovery zone having a countercurrent flow of gas and internal means for controlling backmixing and residence times, said internal means also containing a circulating heat transfer fluid.

10 Claims, 4 Drawing Figures

PROCESS AND DEVICE FOR RECOVERING HEAT FROM A PARTICULATE SOLID

BACKGROUND OF THE INVENTION

In processes for producing synthetic hydrocarbonaceous products by pyrolysis from hydrocarbon-bearing materials, such as from oil shale or tar sands, a substantial amount of hot mineral residue is produced which must be disposed of. It is generally desirable to substantially lower the temperature of this residue prior to disposal both to aid in handling and to recover the heat from the residue which might otherwise be lost. Heat recovery from such materials presents special problems due to the nature of the residue and the large volume of material that must be handled. For example, the mineral residue remaining following the pyrolysis of oil shale contains a wide range of particle sizes varying from a fine powder (perhaps 150 microns) to fairly coarse granules (0.25 inches). In addition, since a ton of oil shale must be processed to obtain about 10 to 35 gallons of shale oil, a large volume of mineral residue must be handled. Conventional heat exchanges, such as shallow fluidized beds, have severe limitations when applied in processes of this type.

An efficient heat exchanger for use in a retorting process of this nature must be able to handle a large volume of material composed of a diversity of particle sizes and efficiently transfer the heat from the solid residue to a desired heat transfer fluid. The relatively long residence times required for efficient heat transfer is contrasted against the need to move enormous amounts of hot residue. For example in a commercial plant producing 100,000 barrels of oil per day approximately 300,000 tons of raw shale (assuming 20 gallons per ton of shale) must be processed per day. Since the inorganic component of the shale constitutes about 80% by weight of the raw shale, the magnitude of this problem becomes apparent.

SUMMARY OF THE INVENTION

The present invention is directed to a process for recovering heat from a hot particulate solid containing diverse particle sizes which comprises:

(a) fluidizing the hot particulate solid in a first zone with a gas having a lower initial temperature than the solid, whereby the solid is partially cooled and the fluidizing gas is heated;

(b) introducing the partially cooled particulate solid from the first zone into the top of a vertically elongated second zone containing internal means to limit substantial vertical backmixing and to increase the average residence time of the particulate solids passing downward therethrough;

(c) passing a relatively cool gas upward through the second zone in general countercurrent flow to the downward moving particulate solids at a velocity sufficient to partially fluidize the particulate solids and to allow a significant transfer of heat between the particulate solid and the gas;

(d) recovering the heated gas from the first and second zones; and (e) removing the cooled particulated solids from the bottom of the second zone.

In its most desirable form the process for recovering heat described herein is also used to heat a heat transfer fluid other than the gases passing in direct contact with the solids in the first and second zones. Most preferably this heat transfer fluid is circulated through heating coils contained in the internals found in the second zone. Thus the internal means used to control the passage of solids and gases through the second zone also serve as a heat transfer surface between the solids and gases on the outside and a heat transfer fluid circulated through the inside.

The present invention also is directed to a heat transfer device for the transfer of heat from a hot particulate solid to a relatively cool gas and heat exchange fluid, said heat recovery device comprising:

(a) a vertically elongated outer vessel divided into an upper and lower zone;

(b) the upper zone being provided with an inlet and an outlet suitable for the passage of a particulate solid, said outlet serving also as a passage for communication between the upper zone and the top of the lower zone;

(c) the upper zone being further provided with a gas outlet and a first gas distributor suitable for fluidizing the particulate solid;

(d) the lower zone being provided with a second gas distributor and being designed for the passage of a gas upwardly therethrough at a preselected velocity;

(e) a plurality of material flow distributors internally disposed within the lower zone for substantially limiting gross vertical backmixing and for increasing the average residence time of particulate solids passing downward therethrough;

(f) means for circulating a heat transfer fluid through the material flow distributors;

(g) a gas outlet at the top of the lower zone; and (h) a solids outlet at the bottom of the lower zone.

DETAILED DESCRIPTION OF THE INVENTION

Figure 1:
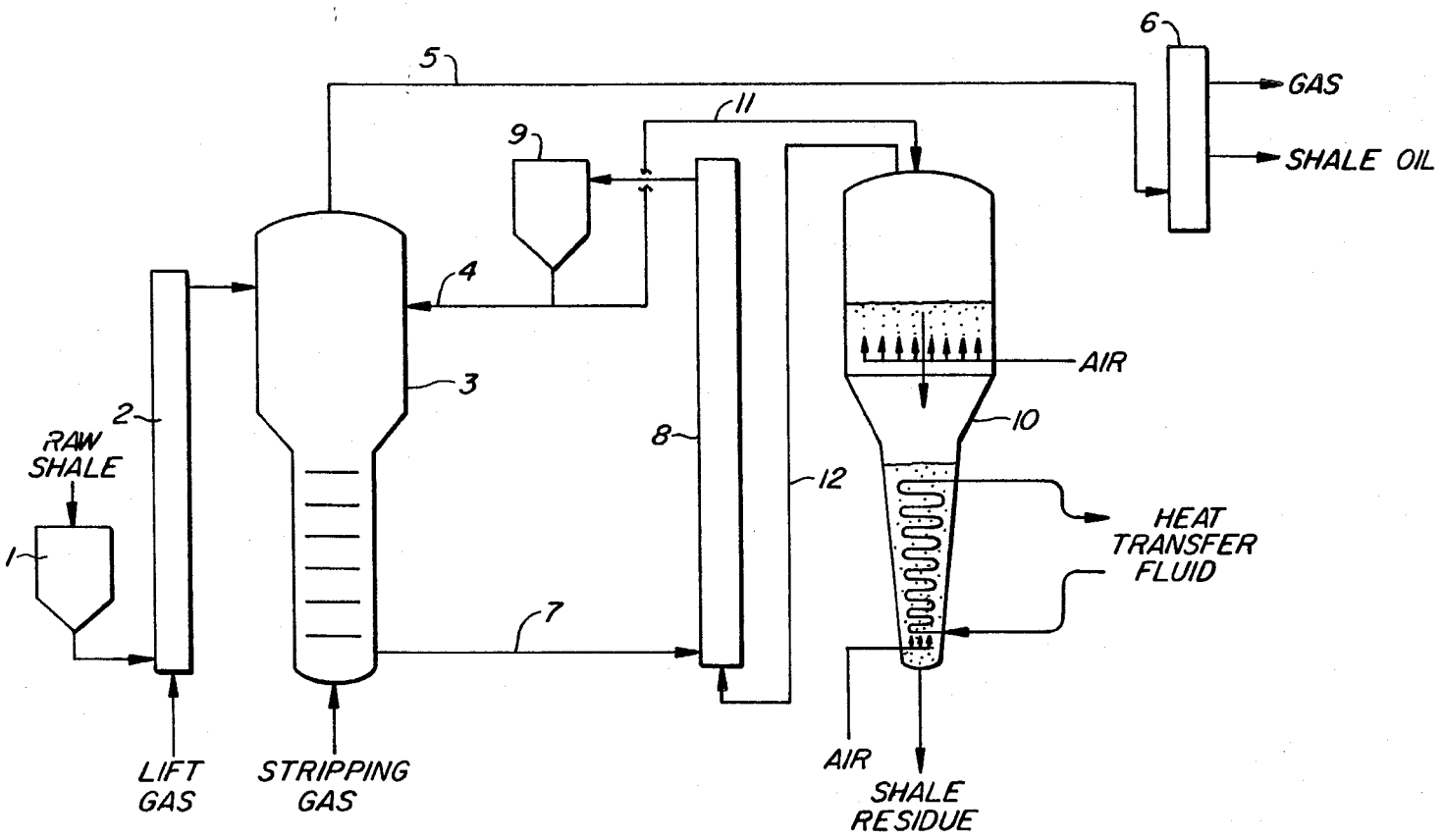
FIG. 1 is a schematic representation of a retorting process for a hydrocarbonaceous solid, such as oil shale, in which the process described herein may be used.

Referring to FIG. 1, a schematic representation is shown of a typical process for retorting oil shale in which the heat recovery method described herein has been incorporated. In this process raw oil shale is crushed and ground to a particulate solid having a maximum particle size of about ¼ of an inch. The crushed raw shale is fed to a holding bin 1 in which it is temporarily stored before being passed to a liftpipe preheater 2 which raises the temperature of the shale particles to about 800° F. The preheated particles are passed into the upper part of a retorting vessel 3 in which the pyrolysis of the hydrocarbons in the raw shale takes place. In the retorting process used to illustrate the invention, the raw shale is further heated in the retorting vessel 3 to about 900° F. by hot recycled burned particles of shale entering the retorting vessel via conduit 4. A stripping gas enters the retorting vessel near the bottom and partially fluidizes the descending shale particles. A full description of such a retorting process is described in detail in U.S. Pat. No. 4,199,432 incorporated herein by reference. Other methods for retorting the shale may also be used in combination with the heat recovery method described herein, but the retorting method contained in U.S. Pat. No. 4,199,432 offers certain advantages over other processes which could be employed. Product vapors, i.e. hydrocarbonaceous gases released by pyrolysis, mixed with stripping gas pass out of the retorting vessel via gas conduit 5. The gases from the retort are carried to a separation zone 6 where the condensable product, i.e. shale oil, is separated from the non-condensable gases.

The retorted shale leaving the bottom of the retorting vessel 3 contains a residual carbonaceous material which may be burned to provide heat for the pyrolysis. Therefore, the retorted shale is sent via conduit 7 to liftpipe combustor 8 where the residual carbonaceous material is burned in the presence of oxygen. The hot burned shale particles are collected in bin 9 and recycled to the retorting vessel 3 via conduit 4, or alternately they are sent to the heat recovery unit 10 via conduit 11. In the heat recovery unit 10 the heat contained in the burned shale is transferred to air and a heat transfer fluid by a process which will be discussed in detail below. The hot air heated by the hot burned shale in the heat recovery unit is used as the lift gas for the liftpipe combustor 8 and is transferred from the heat recovery unit to the combustor via conduit 12. The cooled shale residue is removed from the bottom of the heat recovery unit and is disposed of in an environmentally acceptable manner.

Figure 2:
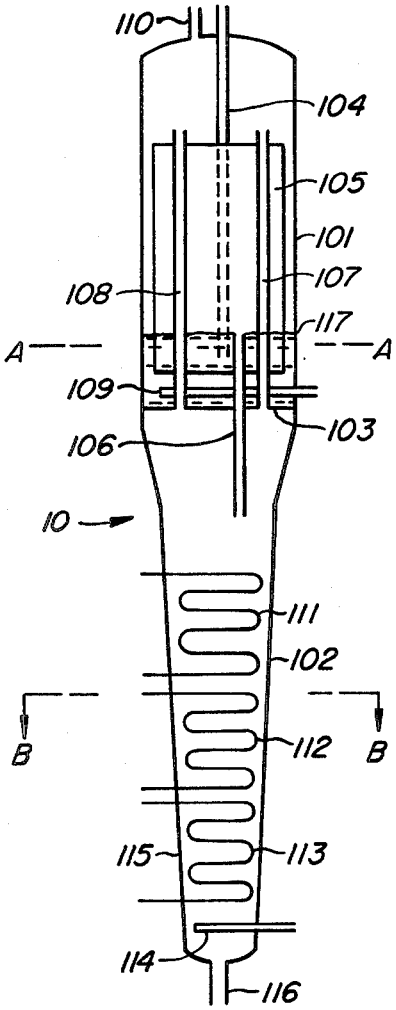
FIG. 2 is a vertical cross-sectional representation of a heat exchange device using the process described herein.
Figure 3:
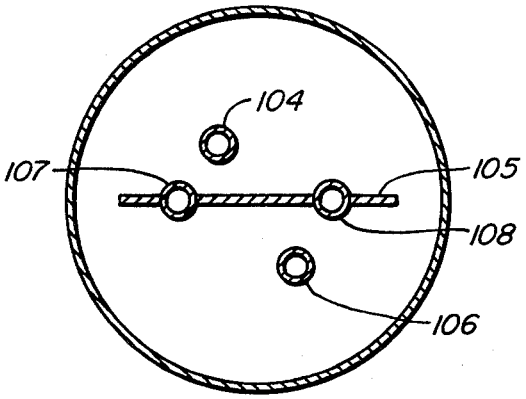
FIG. 3 is a horizontal cross-section of the heat exchange device shown in FIG. 2 taken through the fluidized bed of the first zone illustrating the arrangement of the central baffle and various conduits.

The operation of the heat recovery unit 10 is illustrated in detail by FIG. 2. The unit is divided into an upper zone 101 and a lower zone 102 separated by a plate 103. The hot burned shale leaving the combustor enters the upper zone 101 via the net shale inlet pipe 104. The upper zone 101 is divided into two vertical halves by a vertical baffle 105. A shale overflow drawpipe 106 is located in the vertical half of the upper zone opposite the shale inlet pipe 104. The shale overflow drawpipe serves as communication between the upper zone 101 and the lower zone 102. Also communicating between the upper and lower zones are two interstage gas pipes 107 and 108. The relative location of each of the pipes to the vertical baffle in the upper zone is best explained by reference to FIG. 3 which shows a horizontal cross-section of the upper zone taken at position A. Returning to FIG. 2, just above the plate 103 that divides the unit into the upper and lower zones is an upper gas distributor 109 for fluidizing the solids in the upper zone. A gas outlet 110 at the top of the zone is used to remove the heated gas from the unit.

Figure 4:
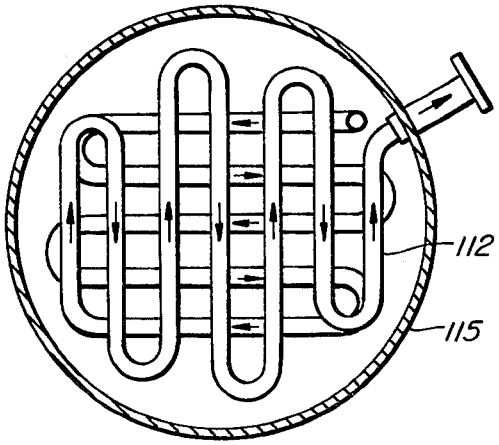
FIG. 4 is a horizontal cross-section of the heat exchange device shown in FIG. 2 showing one tray that serves as an internal in the partially fluidized zone.

The lower zone 102 contains heat transfer coils 111, 112, and 113 which also serve as baffles for the controlled distribution of both solids and gases passing through the lower zone. The heat transfer coils are arranged to form open horizontal trays, one of which is illustrated in FIG. 4 in a cross-section of the lower zone taken at a position designated as B in FIG. 2. The coils are thus able to serve both as internal flow distributors for materials moving vertically through the lower zone and as heat transfer coils for a heat transfer fluid passing through the inside of the coils.

Returning to FIG. 2, a lower gas distributor 114 is located near the bottom of the lower zone. The containment vessel 115 of the lower zone is swagged in order to maintain a relatively constant gas velocity in the lower zone. A residue withdrawal pipe 116 at the bottom of the lower zone serves as an exit for the cooled shale leaving the heat recovery unit.

In operation hot burned shale from the combustor enters the heat recovery unit through the net shale inlet pipe 104. At this point the burned shale is at a temperature of about 1350° F. The shale particles form a bed of solids in the bottom of the upper zone 101. The maximum height of the bed of shale particles in the upper zone is shown as a line 117. Relatively cool air, e.g. about 350° F., entering throughout the upper gas distributor 109 is used to fluidize the bed of shale. The air is heated by the hot shale to about 900° F. as it passes through the bed, and at the same time the shale particles are cooled to about 900° F. The shale overflow drawpipe 106 is used to transfer the partially cooled particles of shale from the upper zone to the lower zone of the heat recovery unit. The vertical baffle 105 in the upper zone assures a sufficient residence time in the upper zone to cool the shale particles to the desired temperature prior to transfer into the lower zone 102.

After entering the lower zone the partially cooled particles of shale pass downward in general countercurrent flow to a flow of relatively cool air (e.g. 350° F.) entering the bottom of the lower zone through the lower gas distributor 114. The velocity of this flow of gas in the lower zone is sufficient to only partially fluidize the descending particles of shale. Thus in the lower zone the shale particles will be classified into at least two categories, i.e. those particles having a terminal velocity less than the superficial velocity of the gas flow and those particles having a terminal velocity greater than the superficial velocity of the gas flow. As used herein terminal velocity refers to the maximum velocity achieved by a given size of particle falling through a long column of stagnant air. Thus when the terminal velocity of a given particle equals or exceeds the superficial velocity of the countercurrent gas flow, that particle will become fluidized. Likewise, particles having a greater terminal velocity than the superficial velocity of the gas will not be fluidized. These later particles in the absence of the internals will drop rapidly to the bottom of the lower zone resulting in an insufficient residence time for efficient heat exchange.

To solve this problem the lower zone contains a series of vertical trays formed from the heat transfer coils 111, 112, and 113. These trays control the passage of both solids and gases through the lower zone. The trays serve to increase the residence time of the non-fluidized shale particles. This increased residence time of the larger particles makes it possible to achieve more efficient heat exchange between the hot shale particles and both the countercurrent gas flow and the heat exchange fluid inside the coils. In addition, the trays prevent gross vertical backmixing of all solids passing downward through the lower zone. This encourages plug flow of the solids and effectively forms a stratified vertical temperature profile in the lower zone. Said another way, the hottest particles will be found at the top of the lower zone with the particles becoming progressively cooler in the lower parts of the zone. The internals assure that the cooler particles are not backmixed with the hotter particles above them. This, of course, is in contrast to a fully fluidized bed in which gross vertical (top to bottom) backmixing takes place.

The vertical trays also control the passage of the gas upward through the lower zone. In the absence of internals the gas would tend to coalesce into successively larger bubbles as it passes upward through the bed of solids. These large bubbles will prevent smooth operation of the bed and efficient heat transfer from the hot solids. Thus the trays are also designed to limit maximum bubble size. The overall effect of the internals is to promote efficient heat transfer from the solids while achieving higher solids throughputs than would be possible in their absence.

The cooled shale particles (about 400° F.) collect in the bottom of the lower zone and are drawn off for disposal through the residue withdrawal pipe 116. The heated gases leaving the top of the bed of solids in the lower zone pass into the upper zone by means of the two interstage gas pipeways 107 and 108. The heated gas from both the lower zone and the upper zone leave the heat recovery unit via the gas outlet 110 in the top of the upper zone. The heat transfer fluid circulated through the heat transfer coils may be used for various purposes such as driving the compressors that are used to create the gas flows needed for various parts of the total process.

In general, the upper fluidized zone of the heat recovery unit is similar to a conventional fluidized bed of solids. The velocity of the fluidizing gas must be sufficient to fluidize all of the particles present in the bed. This velocity will depend on the maximum size of the particles in the solids. The depth of the bed in the upper zone must be relatively shallow, usually about 4 feet or less, for efficient operation when the velocity of the fluidizing gas is in the range of about 4 feet per second.

In contrast, the bed of solids in the lower zone may be relatively deep, e.g. about 14 feet, and the gas velocity less, e.g. about 2 to 4 feet per second. The spacing and design of the trays is important for optimal bed performance and heat transfer. In the design described above the trays should contain at least 50% open area, preferably about 60% open area, and be spaced at about 5- or 6-inch intervals. The material, size and thickness of the tubes used to form the coils of the trays are important in transferring heat across the coil surfaces to the heat transfer fluid inside. While other means can be devised to circulate heat transfer fluid through the internals, the most convenient means is by employing trays formed by overlapping serpentine coils as shown in FIG. 4.

A heat exchange device constructed according to the description contained herein will usually have a solids throughput capacity of between about 1000 lbs/hr-ft$^2$ and about 8000 lbs/hr-ft$^2$, more commonly between about 2000 lbs/hr-ft$^2$ and about 4000 lbs/hr-ft$^2$. As one skilled in the art will recognize the actual throughput will vary significantly with modifications in the tray design, spacing, gas velocity, etc. Optimal operation depends on a balance between maximum solids throughput and efficient heat transfer.

In general, the trays formed from the heating coils in the lower zone should have between about 30% and about 70% open area, preferably at least 50% open area. When referring to the open area of the trays, it is meant that percent of the horizontal cross-sectional area which is open. Preferably, the open area will be composed of openings having a maximum dimension in the range of from about 3.8 to about 10 centimeters.

Using the invention disclosed herein non-fluidized particles passing through the partially fluidized zone will achieve a mean residence time of at least 70%, but more preferably at least 90%, of the average residence time of all particles passing through the vessel. Thus the internals have a greater effect on the residence time of the larger non-fluidized particles than on the smaller fluidized fraction.

As noted above, whether a given size of particle is fluidized or non-fluidized in the lower zone (partially fluidized zone) depends on the terminal velocity of the particle and the superficial velocity of the gas flow. Likewise, the average residence time of a given size of particle is dependent on such factors as the number of trays present, the velocity of the gas, the terminal velocity of the particle, the vertical spacing of the trays, the percent of open area in the trays and the size of the openings in the trays.

In general, it has been found that the coarser particles tend to have a shorter residence time than the average residence time of all particles. This means that the body of solids in the lower zone reaches an equilibrium size distribution finer than that of the feed. Low open-area trays have been found to limit this tendency and produce a body of solids in the lower zone with a similar size distribution to that of the feed. Open tray structures, on the other hand, produce beds highly enriched in fines.

Thus it is not possible to give a precise cut size at which particles become fluidized in the lower zone in the absence of a definition of all of the concerned parameters. In general, a cut size of about 12 mesh (Tyler standard sieve) has been found to be a useful cut size when the particulate solid is retorted oil shale. However, in carrying out the process of this invention the precise cut size employed is less important than finding the optimal trade-off between solids throughput and sufficient residence time to accomplish the desired heat recovery. Thus the cut size between fluidized and non-fluidized particles is usually controlled by the objectives of the process and the structural design of the heat transfer device rather than the other way around.

As noted above, the trays also control the flow of gas passing countercurrent to the descending solids by limiting bubble size. Slugging of the bed is unfavorable from several respects, but the prime disadvantages are, first, poor heat transfer between the solids and the large volume/low surface area bubbles and, second, damaging vibrations in the heat exchanger. The number of trays in the partially fluidized zone will depend on the height of the bed, but in order to achieve the objectives of the invention a minimum of two trays must be present. Acceptable internals should not permit bed pressure drop fluctuations in excess of 5% of the total means bed pressure drop, and the fluctuations are more preferably maintained in the range of 1 to 3%. In the optimal system the pressure drop across the body of solids is approximately equal to that observed in a fully fluidized bed.

Various heat transfer fluids may be circulated through the coils of the partially fluidized zone. Water, especially steam, is usually the heat transfer fluid of choice. However, other heat transfer fluids known to those skilled in the art could also be used if desired. Such heat transfer media includes brines, petroleum oils, synthetic fluids, gases, etc.

As noted above the bed of solids in the lower zone becomes stratified along a vertical temperature profile with the hottest material at the top of the bed. Therefore, the heat transfer fluid passing through the upper heat transfer coils will be heated to a higher temperature than fluid passing through the lower coils. For this reason, it may be desirable to use the heated fluid from different levels of the lower zone for different purposes depending on the temperature requirements of the end use. This flexibility could be an advantage under certain circumstances.

In constructing a heat exchange device to carry out the invention described herein the fluidized zone and partially fluidized zone need not be placed in a superior and inferior position, respectively, as illustrated in FIG. 2. The two zones can be separated and placed on the same level. In addition, the partially fluidized zone could be used alone without a fully fluidized stage preceding it. However, for the most efficient operation a fully fluidized zone should be used ahead of the partially fluidized zone.

What is claimed is:

1. A process for recovering heat from a hot particulate solid containing diverse particle sizes which comprises:

(a) fluidizing the hot particulate solid in a first zone with a gas having a lower initial temperature than the solid, whereby the solid is partially cooled and the fluidizing gas is heated;

(b) introducing the partially cooled particulate solid from the first zone into the top of a swagged vertically elongated second zone containing internal means to limit substantial vertical backmixing and to increase the average residence time of the particulate solids passing downward therethrough;

(c) passing a relatively cool gas upward through the second zone in general countercurrent flow to the downward moving particulate solids at a velocity sufficient to only partially fluidize the particulate solids and to allow a significant transfer of heat between the particulate solid and the gas;

(d) recovering the heated gas from the first and second zones; and (e) removing the cooled particulate solids from the bottom of the second zone.

2. The process of claim 1 wherein the partially cooled particulate solid passing through the second zone is also used to heat a heat transfer fluid circulating through the internal means used to control backmixing and increase residence times of the descending solids.

3. A process for recovering heat from a hot particulate solid containing diverse particle sizes which comprises:

(a) introducing the hot particulate solid into the top of a swagged vertically elongated heat transfer zone containing internal means to limit substantial vertical backmixing and to increase the average residence time of the particulate solids passing downward therethrough;

(b) passing a relatively cool gas upward through the heat transfer zone in general countercurrent flow to the downward moving particulate solids at a velocity sufficient to only partially fluidize the particulate solids and to allow a significant transfer of heat between the solid and the gas;

(c) circulating through the internal means used to control backmixing and increase residence times of the descending solids a heat transfer fluid at a temperature below that of the particulate solids, whereby the solids are cooled and the heat transfer fluid is heated;

(d) recovering the heated gas from the heat transfer zone; and (e) removing the cooled particulate solids from the bottom of the heat transfer zone.

4. The process of claim 3 wherein the non-fluidized particles in the solids have a mean residence time of at least 70% of the average residence time of all particles passing through the heat transfer zone.

5. The process of claim 3 wherein the heat transfer fluid circulated through the internal means is steam.

6. The process of claim 3 wherein the velocity of the gas passing in countercurrent flow to the descending solids is in the range of from about 2 feet per second to about 4 feet per second.

7. The process of claim 3 wherein the particulate solid is the residue from retorted oil shale.

8. The process of claim 7 wherein the solids throughput is in the range of from about 1000 lbs/hr-ft$^2$ to about 8000 lbs/hr-ft$^2$.

9. A heat recovery device for the transfer of heat from a hot particulate solid to a relatively cool gas and heat exchange fluid which comprises:

(a) a vertically elongated outer vessel divided into an upper and a swagged lower zone;

(b) the upper zone being provided with an inlet and an outlet suitable for the passage of a particulate solid, said outlet serving also as a passage for communication between the upper zone and the top of the lower zone;

(c) the upper zone being further provided with a gas outlet and a first gas distributor suitable for fluidizing the particulate solid;

(d) the lower zone being provided with a second gas distributor and being designed for the passage of a gas upwardly therethrough at a preselected velocity;

(e) a plurality of material flow distributors internally disposed within the lower zone for substantially limiting gross vertical backmixing and for increasing the average residence time of particulate solid passing downward therethrough;

(f) means for circulating a heat transfer fluid through the material flow distributors;

(g) a gas outlet at the top of the lower zone that serves as a means of open communication with the upper zone;

and (h) a solids outlet at the bottom of the lower zone.

10. The heat recovery device of claim 9 wherein the material flow distributors comprise at least 2 vertically-spaced, horizontally-disposed trays formed from a cross grid of overlapping serpentine heat transfer coils, each of said material flow distributors having an open area in the range of from about 30% to about 70% of the total cross-sectional area, said open area being composed of openings between the adjacent coils having a maximum dimension in the range of from about 3.8 to about 10 centimeters.

* * * * *